US007750507B2

(12) United States Patent
Heisch

(10) Patent No.: US 7,750,507 B2
(45) Date of Patent: Jul. 6, 2010

(54) SINGLE COIL PAIR, MULTIPLE AXIS INDUCTIVE POWER COUPLING APPARATUS AND METHOD

(75) Inventor: Randall R. Heisch, Georgetown, TX (US)

(73) Assignee: International Business Machines Corporation, Armonk, NY (US)

( * ) Notice: Subject to any disclaimer, the term of this patent is extended or adjusted under 35 U.S.C. 154(b) by 553 days.

(21) Appl. No.: 11/770,049

(22) Filed: Jun. 28, 2007

(65) Prior Publication Data

US 2009/0001817 A1 Jan. 1, 2009

(51) Int. Cl.

| | |
|---|---|
| ***H01F 27/42*** | (2006.01) |
| ***H01F 37/00*** | (2006.01) |
| ***H01F 38/00*** | (2006.01) |
| *H01F 21/04* | (2006.01) |
| *H01F 21/06* | (2006.01) |

(52) U.S. Cl. ..... 307/104; 336/117; 336/118; 336/119; 336/120; 336/121; 336/122; 336/123

(58) Field of Classification Search ..... 307/104; 336/117–123

See application file for complete search history.

(56) References Cited

U.S. PATENT DOCUMENTS

| | | | | |
|---|---|---|---|---|
| 4,800,328 | A | 1/1989 | Bolger et al. | |
| 5,519,262 | A | 5/1996 | Wood | |
| 5,748,157 | A | 5/1998 | Eason | |
| 2007/0188284 | A1 * | 8/2007 | Dobbs | 336/120 |

* cited by examiner

*Primary Examiner*—Stephen W Jackson
*Assistant Examiner*—Dharti H Patel
(74) *Attorney, Agent, or Firm*—Stephan J Walder, Jr.; David A. Mims, Jr.

(57) ABSTRACT

An electronics support apparatus for rotating electronics is provided that eliminates the need for electrical contact brushes and/or reduces the number of inductive power coupling coil pairs required to provide power to the rotating electronics. With the apparatus, a single inductive power coupling coil pair is utilized in which the coils are oriented at approximately 90 degrees, i.e. at a right angle, to each other, e.g., the "outer" coil (secondary transformer coil) is oriented approximately 90 degrees to the "inner" coil (primary transformer coil). A transformer core, or "elbow core," having an approximately 90 degree bend is provided for coupling the magnetic energy of the primary transformer coil with the secondary transformer coil, thus imparting or coupling energy simultaneously through 2 axes of motion.

20 Claims, 3 Drawing Sheets

SINGLE COIL PAIR, MULTIPLE AXIS INDUCTIVE POWER COUPLING APPARATUS AND METHOD

BACKGROUND

1. Technical Field

The present application relates generally to an improved apparatus for moving electronics in at least two degrees of freedom. More specifically, the present application is directed to an apparatus having a single coil pair, multiple axis inductive power coupling which eliminates the need to use brushes or the like to provide an electrical contact for providing electrical power to electronics coupled to the apparatus.

2. Description of Related Art

In a number of different types of apparatus, electronics must be able to be moved in a rotating manner through one or more degrees of freedom. Typically, the electrical power for running the electronics must be provided to the electronics via electrical lines provided on the support structure for the electronics. The support structure must be configured to permit the rotation motion of the electronics. Thus, in order to provide the electrical power along lines of a rotational support structure, electrical contact brushes or inductive power coupling coil pairs are used to provide an electrical contact with a power source.

Electrical brushes and brush materials are used in conjunction with slip rings, commutators, or other contact surfaces to maintain an electrical connection in rotary and linear sliding contact applications. Electrical brushes and brush materials require very good frictional characteristics combined with high to moderate conductivity. Electrical brushes may be made from a plurality of different types of materials depending on the particular use for which they are intended. For example, graphite brush materials are used for high power equipment while metal brushes or sliding contacts are used for signal or low power applications.

Inductive power coupling coil pairs comprise two coils of electrical conductors, i.e. wire, one coil acting as a primary transformer coil and the other coil acting as the secondary transformer coil. An electrical current is passed through the primary transformer coil which causes a magnetic flux due to the windings of the primary transformer coil. The magnetic flux inductively imparts an electrical current in the secondary transformer coil. Because the electrical current is created in the secondary transformer coil through induction, it is not necessary that the two coils be physically attached to transfer the electrical current. Thus, a greater degree of freedom of motion is achievable through use of the inductive power coupling coil pair.

FIG. 1 is an exemplary diagram of a known rotary electronics support structure in which electrical contact brushes are utilized. As shown in FIG. 1, the support structure comprises a first arm A 120 that rotates about a first axis, i.e. the Y-axis, and a second arm B 110 that rotates about a second axis, i.e. the X-axis. The arms are coupled to coils of an inductive power coil pair comprising an inner coil 140 and an outer coil 150. The inner coil 140 and the outer coil 150 are concentric and aligned or oriented such that they are both in the same plane, i.e. the X-plane in the depicted example.

The outer coil 150, which operates as the secondary transformer coil, rotates with arm A 120, i.e. is fixed to arm A 120, and provides power to electronics (not shown) which may be attached to the end of arm A 120 via one or more wires running along the arm A 120 from the outer coil 150. The inner coil 140 operates as the primary transformer coil of the inductive power coupling coil pair and thus inductively couples power into the outer coil 150. The inner coil 140 is attached or fixed to the arm B 110. Thus, by rotating arm B 110 about the X-axis, the entire support structure is rotated around the X-axis. Meanwhile, arm A 120 is rotatable around the Y-axis at the same time.

Since arm B 110 rotates about the X-axis, electrical contact brushes 130, or an additional inductive power coupling coil is required to connect a power source to the entire apparatus. That is, the electrical contact brushes 130, or an additional inductive power coupling coil, provides a contact with a power source (not shown) and is coupled to wires providing a current to the inner coil 140. The inner coil 140 inductively couples power into the outer coil 150 due to the current and a motion of the arm A 120 about the Y-axis which causes a magnetic flux on the outer coil 150. The power in the outer coil 150 is then provided to the electronics (not shown) attached to arm A 120 via one or more wires attached to arm A 120.

Electrical contact brushes have several disadvantages. Electrical contact brushes wear out over time due to the friction between the electrical contact brush and their corresponding contact. Electrical contact brushes are mechanical in nature and thus, are susceptible to mechanical wear and failure. Moreover, electrical contact brushes cause a great deal of electromagnetic interference/radiation and thus, are electrically noisy. Finally, electrical contact brushes have substantial electrical resistance/impedance.

While it is true that, instead of an electrical contact brush as shown in FIG. 1, one can couple energy through an additional inductive power coupling coil, such as the coils 140 and 150, such inductive power coupling coils have a great deal of energy loss, i.e. the amount of power transferred is limited. Therefore, a second inductive power coupling coil pair (to replace the depicted electrical contact brushes 130 in FIG. 1, for example) would result in insufficient power coupling.

SUMMARY

The illustrative embodiments provide an electronics support apparatus for rotating the electronics that eliminates the need for electrical contact brushes and/or reduces the number of inductive power coupling coil pairs required to provide power to the rotating electronics. With the apparatus of the illustrative embodiments, a single inductive power coupling coil pair is utilized in which the coils are oriented at approximately 90 degrees, i.e. at a right angle, to each other, e.g., the "outer" coil (secondary transformer coil) is oriented approximately 90 degrees to the "inner" coil (primary transformer coil). A transformer core, referred to herein as an "elbow core," having an approximately 90 degree bend is provided for coupling the magnetic energy of the primary transformer coil with the secondary transformer coil.

A first arm is coupled to the secondary transformer coil which provides a mechanism for coupling electronics to be rotated and having one or more electrical power transmission lines for transmitting power from the secondary transformer coil to the electronics. Thus, the first arm is able to be rotated about a first axis passing through a center of the secondary transformer coil and substantially perpendicular to a plane in which the secondary transformer coil is provided.

A second arm is provided which has an inner shaft and an outer shaft. The inner shaft rotates within the outer shaft of the second arm. The inner shaft is coupled to the elbow core and causes, through its rotation within the outer shaft of the second arm which remains fixed, the elbow core to rotate inside the primary transformer coil which is fixed. The elbow core is made of a ferrite material having properties for providing a high magnetic flux due to the rotation within the primary transformer coil and the supply of electrical current to the primary transformer coil. The elbow core couples the magnetic flux, through its approximately 90 degree turn, into the secondary transformer coil which provides power to the electronics at the end of the first arm.

Thus, with the illustrative embodiment, the outer shaft and primary transformer coil are permitted to stay stationary while the inner shaft, the elbow core, and the first arm are permitted to rotate. This allows the first arm to rotate about a first axis and the second arm to rotate about a second axis, as with the known support structures, while eliminating the need for a rotating electrical contact, e.g., electrical contact brushes, or additional inductive power coupling coil pair. With the illustrative embodiments, because the outer shaft and primary transformer coil are stationary, power may be supplied to the primary transformer coil through a simple stationary power source and power transmission lines provided in association with the outer shaft of the second arm.

The apparatus of the illustrative embodiments may be used to provide a support structure for any electronics that are to be rotated in one or more degrees of freedom. For example, in one illustrative embodiment, the apparatus is used to provide a support structure for an array of light emitting elements and the control electronics for the array of light emitting elements. Thus, the array of light emitting elements may be moved in a rotary manner using the apparatus of the illustrative embodiments while still being provided with power for control and illumination of the array of light emitting elements. In this way, a floating image may be generated using the movement of the array of light emitting elements through an area of space.

In one illustrative embodiment, an apparatus is provided that comprises a first arm configured for a portion of the first arm to be rotated about a first axis running along the length of the first arm, a second arm configured to be rotated about a second axis perpendicular to the first axis, and an inductive power coupling coil pair coupled to the first arm and the second arm. The inductive power coupling coil may comprise a first coil coupled to the first arm and a second coil coupled to the second arm such that the first coil and the second coil are substantially perpendicular to one another, and a magnetic core coupled to one of the first arm or the second arm, wherein the magnetic core transfers power, via an induced magnetic flux, from the first coil to the second coil in response to an electrical current being applied to the first coil.

The first arm may comprise an outer shaft configured to be stationary and an inner shaft configured to be rotated within the outer shaft about the first axis. The inner shaft may be coupled to an actuator for rotating the inner shaft within the outer shaft. The inner shaft may be coupled to the magnetic core such that the magnetic core is rotated about the first axis in response to the inner shaft being rotated about the first axis. The magnetic core may be rotated about the first axis within a center of the first coil such that a magnetic flux is created in the magnetic core when the electrical current is applied to the first coil. The outer shaft may be coupled to the first coil and a stationary power source. The stationary power source may be coupled to the first coil by at least one electrical conductor to provide the electrical current from the stationary power source to the first coil.

The magnetic core may be configured to have a first leg and a second leg. The first leg may be approximately 90 degrees in orientation to the second leg. The first leg may be configured to be within a center of the first coil and the second leg may be configured to be within a center of the second coil. When the magnetic flux is generated in the first leg of the magnetic core, the magnetic flux may be transferred through the first leg to the second leg to generate an electrical current in the second coil.

The apparatus may further comprise electronics coupled to the second arm and electrically coupled to the second coil. The second coil may provide electrical current for powering the electronics. The electronics may comprise an array of light emitting elements and control circuitry for controlling illumination of individual light emitting elements of the array of light emitting elements. The array of light emitting elements may comprise a plurality of light emitting diodes.

The control circuitry may control selectively pulsing on/off individual light emitting elements of the array of light emitting elements in accordance with an image to be generated by the array of light emitting elements. The control circuitry may selectively pulse on/off light emitting elements in the array of light emitting elements by receiving an index pulse, from an index pulse generator associated with an actuator providing a force to rotate the portion of the first arm about the first axis, indicative of a position of the electronics along a path of motion of the electronics. The control circuitry may further selectively pulse on/off light emitting elements in the array of light emitting elements by determining a timing for pulsing on/off the light emitting elements based on the index pulse.

The electronics may be moved through a path of motion. The path of motion may be defined by the rotation of the portion of the first arm about the first axis and the rotation of the second arm about the second axis. The array of light emitting elements may be controlled to generate a floating image in a space traversed by the path of motion of the electronics.

The control circuitry may comprise a programmable controller. The programmable controller may be programmed with data corresponding to the image to be generated by the array of light emitting elements. The programmable controller may be programmed via a user interface and one of a wired or wireless communication link between the programmable controller and the user interface.

In another illustrative embodiment, a method of providing an apparatus for moving electronics through a path of motion is provided. The method may comprise providing a first arm configured for a portion of the first arm to be rotated about a first axis running along the length of the first arm, providing electronics coupled to the first arm, providing a second arm configured to be rotated about a second axis perpendicular to the first axis, and providing an inductive power coupling coil pair coupled to the first arm and the second arm. The inductive power coupling coil may comprise a first coil coupled to the first arm and a second coil coupled to the second arm such that the first coil and the second coil are substantially perpendicular to one another. The inductive power coupling coil may further comprise a magnetic core coupled to one of the first arm or the second arm. The magnetic core may transfer power, via an induced magnetic flux, from the first coil to the second coil in response to an electrical current being applied to the first coil. The electronics may be moved through a path of motion by virtue of the rotation of the first arm about the first axis and the rotation of the second arm about the second axis. The electronics may be provided with electrical power via the inductive power coupling coil pair.

The first arm may comprise an outer shaft configured to be stationary and an inner shaft configured to be rotated within the outer shaft about the first axis. The inner shaft may be coupled to an actuator for rotating the inner shaft within the outer shaft. The inner shaft may be coupled to the magnetic core such that the magnetic core may be rotated about the first axis in response to the inner shaft being rotated about the first axis. The magnetic core may be rotated about the first axis within a center of the first coil such that a magnetic flux is created in the magnetic core when the electrical current is applied to the first coil.

The magnetic core may be configured to have a first leg and a second leg. The first leg may be approximately 90 degrees in orientation to the second leg. The first leg may be configured to be within a center of the first coil. The second leg may be configured to be within a center of the second coil such that when the magnetic flux is generated in the first leg of the magnetic core, the magnetic flux may be transferred through the first leg to the second leg to generate an electrical current in the second coil.

These and other features and advantages of the present invention will be described in, or will become apparent to those of ordinary skill in the art in view of, the following detailed description of the exemplary embodiments of the present invention.

BRIEF DESCRIPTION OF THE DRAWINGS

The invention, as well as a preferred mode of use and further objectives and advantages thereof, will best be understood by reference to the following detailed description of illustrative embodiments when read in conjunction with the accompanying drawings, wherein.

DETAILED DESCRIPTION OF THE ILLUSTRATIVE EMBODIMENTS

As discussed above, the illustrative embodiments provide an electronics support apparatus for rotating electronics. The support apparatus of the illustrative embodiments eliminates the need for electrical contact brushes and/or reduces the number of inductive power coupling coil pairs required to provide power to the rotating electronics. The support apparatus of the illustrative embodiments utilizes a dual shaft arm, a pair of coils configured to be at approximately 90 degrees to one another, and a magnetic core, referred to herein as an "elbow core," configured to have a bend of approximately 90 degrees. The arrangement of these elements permits the couplings to the power source to be kept stationary while still allowing a desired range of rotary motion of the arms of the support apparatus to provide the rotation of the electronics. As a result, the complex and wear prone mechanisms associated with electrical contact brushes and inductive power coupling coil pairs may be eliminated in implementations of the support apparatus of the illustrative embodiments.

Figure 1:
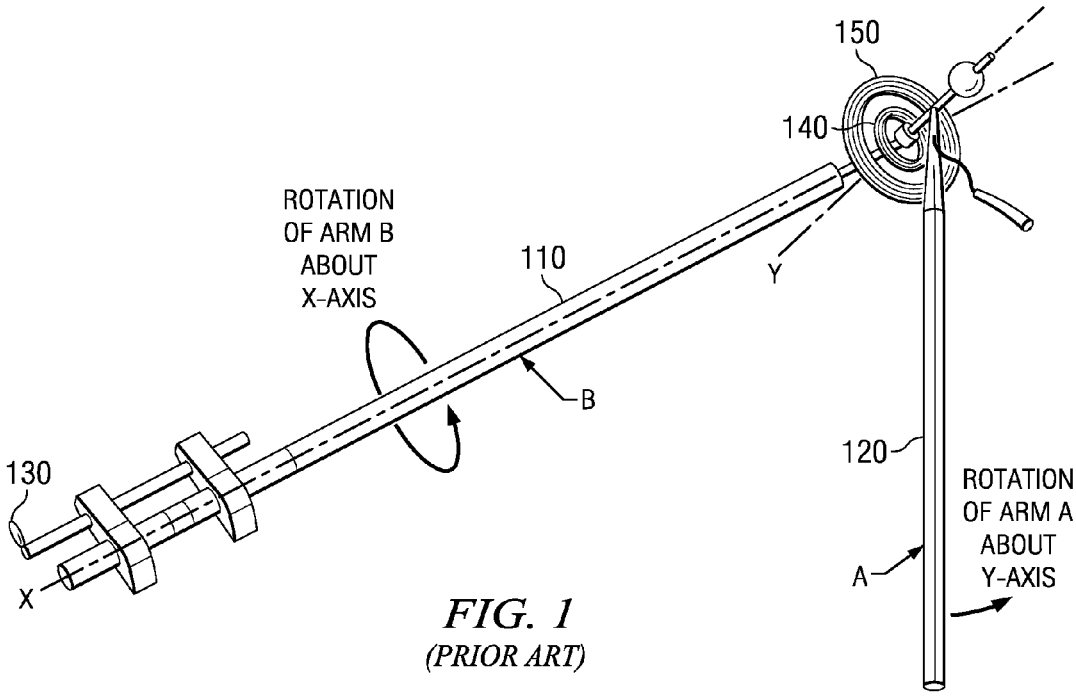
FIG. 1 (PRIOR ART)
FIG. 1 is an exemplary diagram of a known support structure for rotary electronics.
Figure 2:
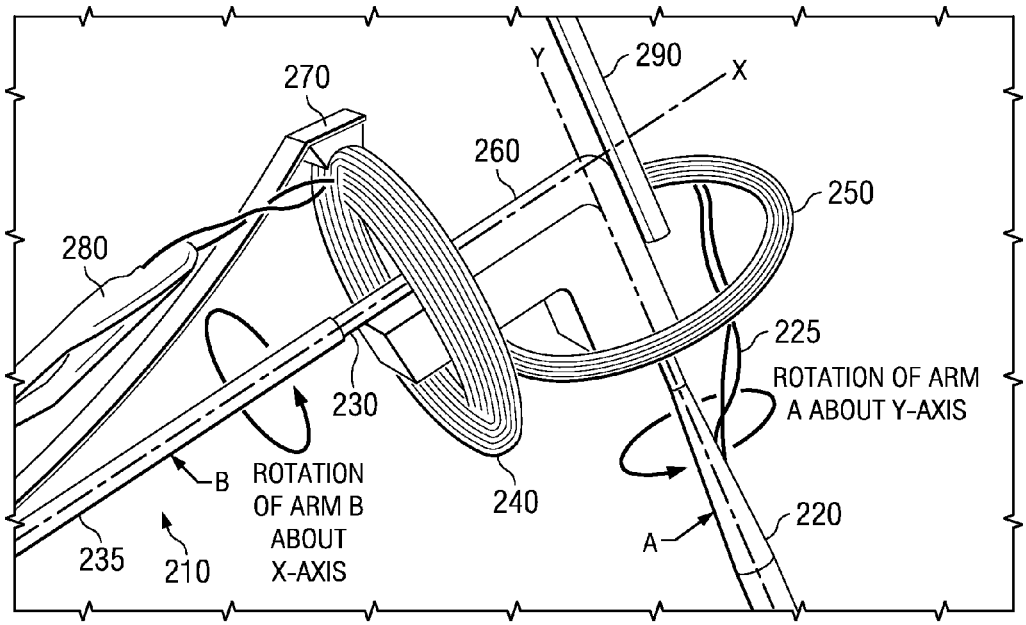
FIG. 2 is an exemplary diagram of the inductive power coupling coil and elbow core of one illustrative embodiment.

FIG. 2 is an exemplary diagram of the inductive power coupling coil and elbow core of one illustrative embodiment. As shown in FIG. 2, a first arm, i.e. arm A 220, is coupled to the secondary transformer coil 250 and is configured to be substantially perpendicular to the Y-axis. The arm A 220 provides a mechanism for coupling electronics (not shown) to be rotated. Arm A 220 has one or more electrical power transmission lines 225 coupled to the secondary transformer coil 250 and attached along the length of the arm A 220 to electronics provided at some point along the length of the arm A 220. The electrical power transmission lines 225 are used to transmit power from the secondary transformer coil 250 to the electronics. The arm A 220 is thus able to be rotated about a first axis, i.e. the Y-axis, passing through a center of the secondary transformer coil 250 and substantially perpendicular to a plane in which the secondary transformer coil 250 is provided. Moreover, the secondary transformer coil 250 is attached to arm A 220 and thus, is also able to be rotated about the Y-axis.

Arm A 220 may be configured to rotate about the Y-axis inside a sleeve, bushing, or bearing that is attached to the magnetic transformer core 260, discussed hereafter. Arm A 220 may be allowed to rotate freely with its motion coming from the rotation of both arm A 220, the rotation of the magnetic transformer core 260 (which rotates about the X-axis as discussed hereafter), and the effects of gravity on the arm A 220 and any electronics attached to arm A 220.

Arm A 220 may be made of any suitable material for providing support for holding electronics (not shown) that may be attached to the arm A 220. Thus, the material selected for arm A 220 should have sufficient strength yet be reasonably light-weight to allow ease of motion about the X and Y axes. Moreover, other factors may be involved in determining the appropriate material to be used for fabricating arm A 220, such as bending of the arm during motion, conductivity, etc.

The secondary transformer coil 250 is preferably formed of a number of windings of electrical conducting material. For example, the secondary transformer coil 250 is preferably formed of a number of windings of wire, as is generally known in the art. The secondary transformer coil 250 is preferably oriented at approximately 90 degrees, i.e. at a right angle, to a primary transformer coil 240. Thus, the secondary transformer coil 250 is not concentric with the primary transformer coil 240 yet, through the use of a magnetic transformer core 260, power is still inductively coupled from the primary transformer coil 240 to the secondary transformer coil 250, as discussed hereafter.

A second arm, i.e. arm B 210, is provided which has an inner shaft 230 and a hollow outer shaft 235. The inner shaft 230 rotates within the outer shaft 235 of arm B 210 about the X-axis. The inner shaft 230 is coupled to a magnetic transformer core 260, referred to herein as an "elbow core," having an approximately 90 degree bend. The elbow core 260 couples the magnetic energy of the primary transformer coil 240 with the secondary transformer coil 250, as discussed hereafter. Through the rotation of the inner shaft 230 about the X-axis within the outer shaft 235 of the arm B 210, the elbow core 260 rotates inside the primary transformer coil 240 which is fixed or stationary. A counter-weight 290 may be attached to the structure, such as at the elbow core 260 in order to provide some balance to the structure, although not completely balanced since in the depicted example it is desirable to allow the force of gravity to cause some motion in arm A 220.

Thus, both the hollow outer shaft 235 and the primary transformer coil 240 are kept stationary while the inner shaft 230 and the attached elbow core 260 are rotated about the X-axis, i.e. an axis of the arm B 210 passing through the length of arm B 210. The primary transformer coil 240 may be attached to the outer shaft 235 by an attachment arm 270 in order to maintain the primary transformer coil 240 stationary as well as position it about one leg of the elbow core 260. Appropriate electrical conductors 280 may be attached to the primary transformer coil 240 and coupled to a stationary power source (not shown) in order to provide an electrical current to the windings of the primary transformer coil 240. The primary transformer coil 240 and the shafts 230 and 235 of the arm B 210 may be made of materials selected for the particular implementation in a manner similar to that discussed above with regard to the secondary transformer coil 250 and the arm A 220.

The elbow core 260 is preferably made of a ferrite material, such as iron or the like, having properties of high magnetic saturation and thus coupling more magnetic energy from the primary transformer coil 240 to the secondary transformer coil 250 than coil pairs that do not have such an elbow core 260. A magnetic flux is generated in the elbow core 260 by the motion of the elbow core 260 within the primary transformer coil 240 and the electrical current provided to the primary transformer coil 240 from a stationary alternating current power source (not shown) via the electrical conductors 280. The frequency of the alternating current supplied by the stationary alternating current power source may be tuned, such as via a function generator and driver electronics (not shown), to the resonant frequency of the coils 240 and 250, the elbow core 260, and the electrical load in order to couple maximum energy at the highest efficiency. The magnetic flux is coupled through its approximately 90 degree turn, into the secondary transformer coil 250 to thereby generate a current in the secondary transformer coil 250. The secondary transformer coil 250 then provides the electrical power from the generated current to the electronics attached to arm A 220.

Thus, with the illustrative embodiment, the outer shaft 235 and primary transformer coil 240 are permitted to stay stationary while the inner shaft 230, the elbow core 260, and arm B 210 are permitted to rotate. This allows the arm B 210 to rotate about the Y-axis and arm A 220 to rotate about the X-axis, as with the known support structures, while eliminating the need for a rotating electrical contact, e.g., electrical contact brushes, or additional inductive power coupling coil pair. With the illustrative embodiments, because the outer shaft 235 and primary transformer coil 240 are stationary, power may be supplied to the primary transformer coil 240 through a simple stationary power source and electrical conductors 280 provided in association with the outer shaft 235 of the arm B 210.

It should be appreciated that the electronics that may be attached to arm A 220 of the support structure/apparatus of the illustrative embodiments may be of any type desired. For example, the electronics may comprise sensors, cameras, display devices, or the like. Such electronics may send and/or receive data communications via wired or wireless mechanisms, such as RF transmissions, infrared transmissions, WIFI, or the like. It should be appreciated that the power requirements of such electronics may dictate the size of the primary and secondary transformer coils 240 and 250 utilized as well as the size of the power supply used. In one illustrative embodiment, the amount of power supplied to the electronics using the support structure/apparatus of the illustrative embodiments is approximately 0.5 to 1.0 watt of power. However, larger amounts of power may be provided by using larger coils and a larger power supply.

Figures 3, 6:
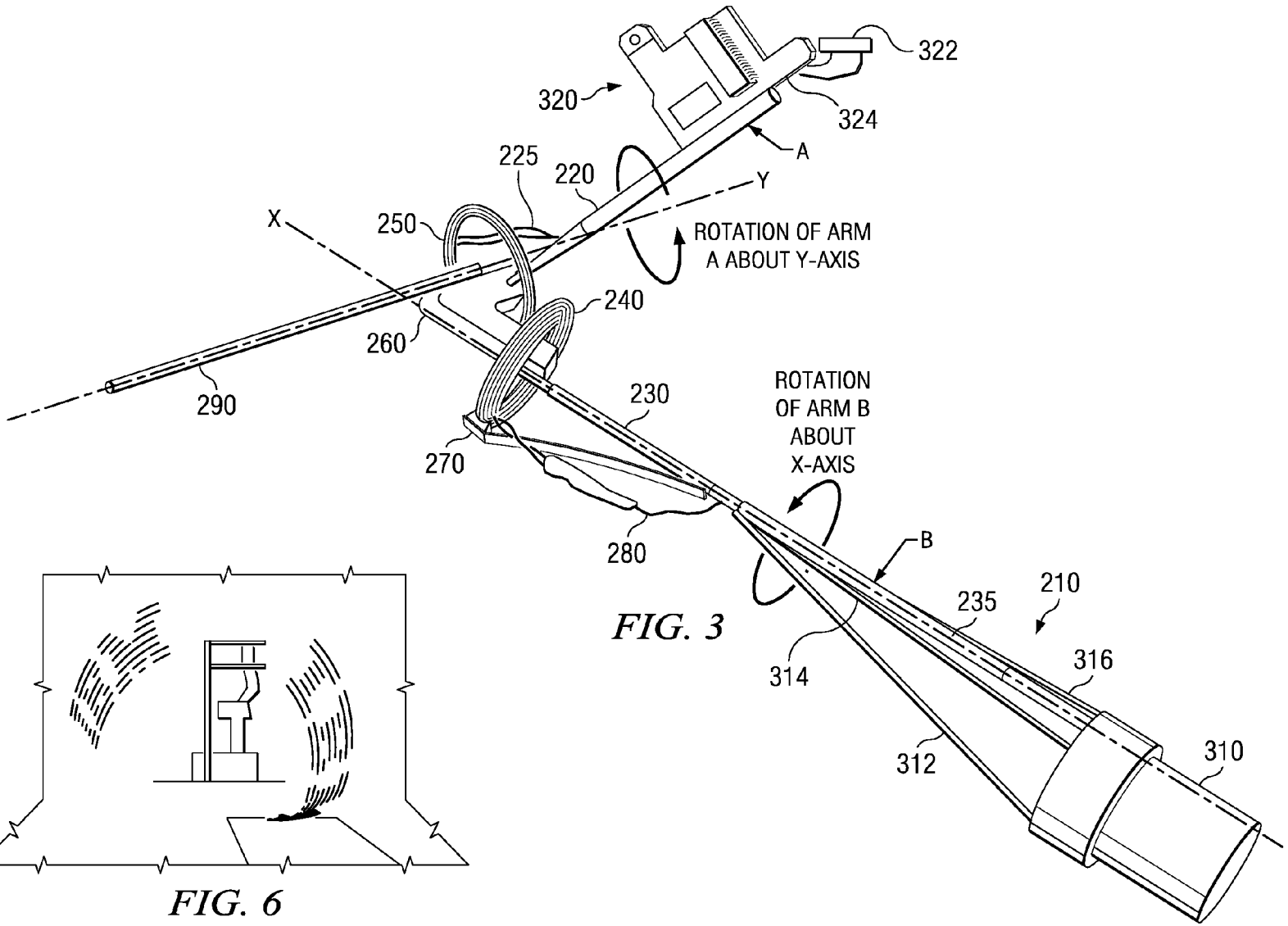
FIG. 3 is an exemplary diagram of a support structure for rotary electronics in accordance with one illustrative embodiment.
FIG. 6 is an exemplary diagram of a floating display generated using the system of FIG. 4 in accordance with one illustrative embodiment.

FIG. 3 is an exemplary diagram of a support structure for rotary electronics in accordance with one illustrative embodiment. It should be noted that, in order to picture the rotation of the arms 210 and 220 of the depicted structure, it should be appreciated that arm A 220 may rotate in a circular path roughly in the same plane as the page it is drawn upon. The whole "page" may then be rotated about the X-axis to thereby simulate the rotation of arm B 210 about the X-axis. In this way, a spherical motion of any electronics attached to arm A 220 is made possible. That is, arm A rotates about the Y-axis in a circular pattern and the Y-axis is also rotated about the X-axis thus imparting a spherical motion to the end of arm A 220 and thus, the electronics if any.

FIG. 3 shows a larger view of the apparatus of FIG. 2 in which the motor 310, stationary supports 312-316, and electronics 320 are visible. As shown in FIG. 3, the motor 310 is provided at one end of arm B 210 and provides a means by which the inner shaft 230 of the arm B 210 may be rotated within outer shaft 235. Stationary supports 312-316 are attached to the outer shaft 235 and the motor 310 to thereby provide support for maintaining the outer shaft 235 stationary relative to the inner shaft 230.

In the depicted example, the electronics 320 are attached to a portion of the arm A 220 at an end opposite that at which the arm A 220 is attached to the secondary transformer coil 250. The electronics 320 in this example are comprised of a microcontroller 324, as may be provided on an integrated circuit board or the like, and an array of light emitting elements 322, such as light emitting diodes (LEDs), or the like. In the depicted example, the electronics 320 are used to provide a floating display of a message/image as the arms A and B 210 and 220 are rotated about their respective X and Y axes. The LEDs of the array of light emitting elements 322 may be illuminated, under the control of the microcontroller 324, to pulse on/off to generate an image that appears to float in space due to the phenomenon of persistence of vision. Persistence of vision is the phenomenon where the human eye continues to perceive an image for nearly $1/16^{th}$ of a second after the image has disappeared. By rapidly changing the illumination of portions of a display in less time than this $1/16^{th}$ of a second, the human eye can be fooled into viewing an image that is not actually present.

For example, in U.S. Pat. No. 5,748,157, entitled "Display Apparatus Utilizing Persistence of Vision," issued May 5, 1998 to Richard O. Eason, a display device is described that uses a wand having a plurality of LEDs at a tip-end of the wand which is moved in a cyclic or repetitive motion while timing the illumination of the LEDs to generate an alphanumeric message that appears to float in mid-air due to persistence of vision of the human eye. A controller is programmed for synchronizing the turning on and off of the LEDs according to a measured cycle time of the swinging motion of the wand back and forth through a region of space. The support structure/apparatus of the illustrative embodiments may be used to provide a similar type of display to that of U.S. Pat. No. 5,748,157, yet in three dimensions of space due to the rotation of the arms A and B 210 and 220 of the structure/apparatus.

Figure 4:
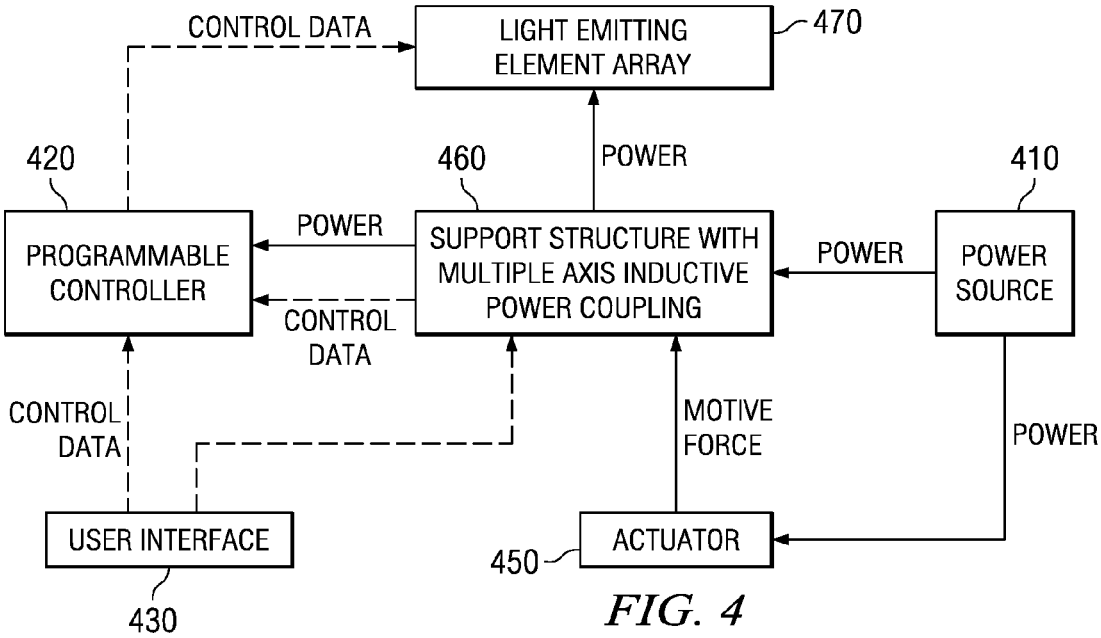
FIG. 4 is an exemplary block diagram of a system that utilizes the support structure of the illustrative embodiments to provide a rotary display using an array of light emitting elements in accordance with one illustrative embodiment.

FIG. 4 is an exemplary block diagram of a system that utilizes the support structure of the illustrative embodiments to provide a rotary display using an array of light emitting elements in accordance with one illustrative embodiment. As shown in FIG. 4, a power source 410 provides power to an actuator 450, a programmable controller 420, and a light emitting element, eg., LED, array mechanism 470 via the support structure with multiple axis inductive power coupling 460. The support structure with multiple axis inductive power coupling 460 may comprise a structure and/or apparatus similar to that depicted in FIGS. 2 and 3 described above. Power transmission lines as well as the single inductive power coupling coil pair 240, 250 may be used to provide power from the power source 410 to the elements 420 and 470. The programmable controller 420 and LED array mechanism 470 may be provided, for example, on an arm, e.g., arm A 220 in FIGS. 2 and 3, of the apparatus coupled to the secondary transformer coil of the inductive power coupling coil pair, for example.

The actuator 450 is coupled to the support structure 460 and imparts a rotation/oscillation force to at least an inner shaft of one arm of the support structure 460 to cause rotation of the support structure 460 in at least one degree of freedom when powered. The programmable controller 420 may, when powered, control the illumination of individual ones of the LEDs in the LED array mechanism 470 so as to provide a floating display of a message/image. In some illustrative embodiments, an index pulse generator (not shown) may monitor the rotation/oscillation of the actuator 450, and/or the support structure 460, to generate an index pulse that is transmitted to the programmable controller 420 so that the programmable controller 420 may time the illumination of the LEDs according to a determined rotational position of the LED array mechanism 470.

The programmable controller 420 preferably is provided with software, hardware, or any combination of software and hardware, for performing various functions to control the pulsing of the LEDs in the LED array mechanism 470 based on message/image input data pre-programmed into the programmable controller 420 or provided via the user interface 430. While a programmable controller 420 is shown in FIG. 4, it should be appreciated that the illustrative embodiments are not limited to using a programmable controller 420. To the contrary, the programmable controller 420 may be a hardwired digital logic state machine, a simple analog mechanism, or the like.

Assuming that a programmable controller 420 is utilized, a user may input message/image input data for specifying an alphanumeric message or an image to be generated by the LED array mechanism 470. The programmable controller 420 stores this data and uses it to determine which individual LEDs of the LED array mechanism 470 should be pulsed at which time in order to generate the display specified by the stored input data. The timing may be pre-programmed or may be determined, for example, based on index pulses received from an index pulse generator, as discussed above. The user interface 430 may be any type of interface capable of inputting data into the programmable controller 420. Examples of such interfaces include a keyboard, computer mouse, trackball, pointing device, various dedicated real or virtual buttons, a computer with a data connection to the programmable controller 420, or the like. The user interface 430 may be coupled to the programmable controller 420 through wired or wireless communication links such that the data may be transferred from the user interface to the programmable controller 420.

In some illustrative embodiments, the user may input additional display characteristics which the programmable controller 420 may use to control the pulsing of the LEDs in LED array mechanism 470, the motion of the support structure 460, or the like. For example, in some illustrative embodiments, the actuator 450 may be able to change the rotation/oscillation of the support structure 460 based on control signals received from the programmable controller 420. Thus, the user may input data specifying a desired motion path of the support structure 460 which is then achieved by the programmable controller 420 sending appropriate control signals to the actuator 450 to cause the actuator 450 to move the support structure 460 in the manner input by the user. In this way, the user may customize the path of the support structure 460 for a desired effect.

In other illustrative embodiments, the characteristics may include specifying a color of the message/image to be displayed, a periodicity of a change in color of the message/image display, or other effects. In such an embodiment, multiple columns of LEDs of various colors, such as red, green, and blue, may be provided in the LED array mechanism 470 and may be controlled based on the user input data received by the programmable controller 420. The position of each column of LEDs relative to the motion path(s) of the support structure 460 are known a priori by the programmable controller 420, i.e. are stored in the programmable controller 420, and thus, can be used to adjust the timing of the pulsing of the LEDs, such as according to a predetermined base timing or based on index pulses received by the programmable controller 420. Many other customizations may be made using the mechanisms of the illustrative embodiments as will be readily apparent to those of ordinary skill in the art in view of the present description.

Figure 5:
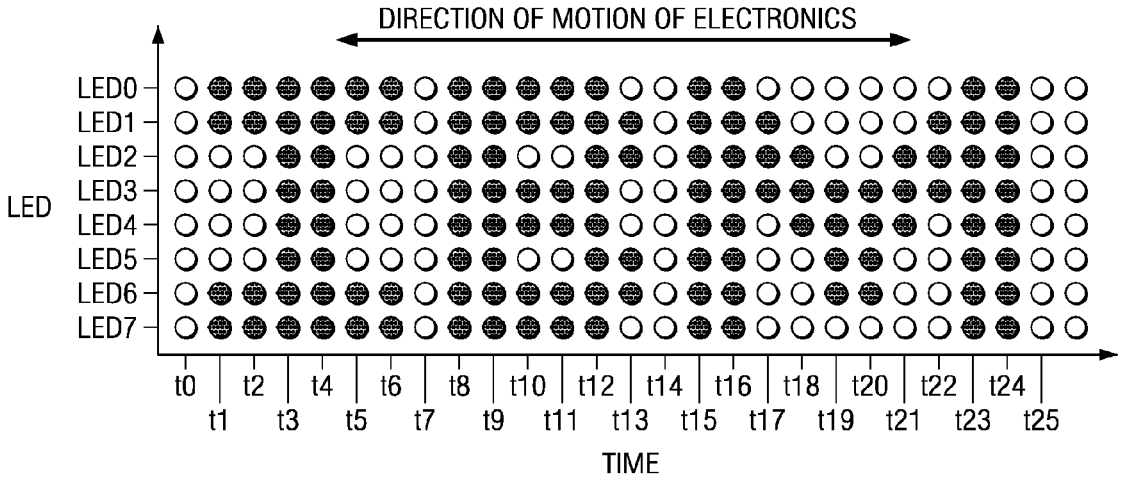
FIG. 5 is an exemplary diagram illustrating the timing of illumination of the light emitting elements of the system of FIG. 4 in accordance with one illustrative embodiment.

FIG. 5 is an exemplary diagram illustrating the timing of illumination of the light emitting elements of the system of FIG. 4 in accordance with one illustrative embodiment. As shown in FIG. 5, the message to be displayed by the apparatus/system is the acronym "IBM." Assuming that the support structure is rotating in a direction corresponding to the time axis, i.e. from left to right of the diagram, the darkened circles represent the LEDs, in the LED array, that are illuminated at the corresponding time point along the time axis. Thus, for example, at a time point t0, none of the LEDs 0-7 are pulsed on. At a second time point t1, the LEDs 0, 1, 6, and 7 are pulsed on to generate a first part of the letter "I". These same LEDs are again pulsed on at time point t2. At a fourth time point t3, all of the LEDs 0-7 are pulsed on to generate the main part of the letter "I". This process continues through time point t25.

It should be appreciated that the difference between time points is very small such that the outside viewer does not discern the serial time points but instead perceives the entire message "IBM" to be present and floating in space at the same time. For example, the time between time points may be the time that it takes an LED to move $1/10^{th}$ of its radius such that an outside viewer does not perceive any "smearing" of the resulting image. The shorter the time between time points the better the resulting image will be up to a limit at which the LEDs are not left on long enough and a faint light output is perceived.

FIG. 6 is an exemplary diagram of a floating display generated using the system of FIG. 4 in accordance with one illustrative embodiment. The diagram in FIG. 6 represents an image obtained using high speed photographic equipment with a relatively slow shutter speed taking a picture of an instance in time of the operation of one illustrative embodiment. As shown in FIG. 6, the support structure of the illustrative embodiment moves the LED array through a motion path that may approximate a sphere in space. The motion of the support structure is at sufficient enough of a speed that the structure and electronics do not appear to be present in the same location as the displayed message "IBM." Thus, the message "IBM" appears to be floating in space. This is because of the high speed at which the support structure, and hence the LED array and other electronics, are moved and the phenomenon of persistence of vision of the human eye which is simulated by the slow shutter speed of the photographic equipment.

It should be appreciated that while the illustrative embodiments are described in terms of using the support structure to provide a floating display apparatus/system, the illustrative embodiments are not limited to such. Rather, the apparatus of the illustrative embodiments may be used to provide a support structure for any electronics that are to be rotated in one or more degrees of freedom.

Moreover, while the illustrative embodiments have been described with regard to an exemplary arrangement of elements, the illustrative embodiments are not limited to the particular arrangements depicted in the figures. To the contrary, many modifications to the arrangements shown may be made without departing from the spirit and scope of the present invention. For example, rather than having an inner shaft rotate about an axis while the outer shaft is maintained stationary, another embodiment may have the outer shaft rotate about the inner shaft, or the like. Other modifications that may be readily apparent to those of ordinary skill in the art in view of the present description are intended to be within the spirit and scope of the present invention.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. An apparatus, comprising:

a first arm configured for a portion of the first arm to be rotated about a first axis running along the length of the first arm;

a second arm configured to be rotated about a second axis perpendicular to the first axis; and an inductive power coupling coil pair coupled to the first arm and the second arm, wherein the inductive power coupling coil comprises:

a first coil coupled to the first arm and a second coil coupled to the second arm such that the first coil and the second coil are substantially perpendicular to one another; and a magnetic core coupled to one of the first arm or the second arm, wherein the magnetic core transfers power, via an induced magnetic flux, from the first coil to the second coil in response to an electrical current being applied to the first coil.

2. The apparatus of claim 1, wherein the first arm comprises:

an outer shaft configured to be stationary; and an inner shaft configured to be rotated within the outer shaft about the first axis.

3. The apparatus of claim 2, wherein the inner shaft is coupled to an actuator for rotating the inner shaft within the outer shaft, and wherein the inner shaft is coupled to the magnetic core such that the magnetic core is rotated about the first axis in response to the inner shaft being rotated about the first axis.

4. The apparatus of claim 3, wherein the magnetic core is rotated about the first axis within a center of the first coil such that a magnetic flux is created in the magnetic core when the electrical current is applied to the first coil.

5. The apparatus of claim 2, wherein the outer shaft is coupled to the first coil and a stationary power source, and wherein the stationary power source is coupled to the first coil by at least one electrical conductor to provide the electrical current from the stationary power source to the first coil.

6. The apparatus of claim 1, wherein the magnetic core is configured to have a first leg and a second leg, and wherein the first leg is approximately 90 degrees in orientation to the second leg.

7. The apparatus of claim 6, wherein the first leg is configured to be within a center of the first coil and the second leg is configured to be within a center of the second coil such that when the magnetic flux is generated in the first leg of the magnetic core, the magnetic flux is transferred through the first leg to the second leg to generate an electrical current in the second coil.

8. The apparatus of claim 1, further comprising:

electronics coupled to the second arm and electrically coupled to the second coil, wherein the second coil provides electrical current for powering the electronics.

9. The apparatus of claim 8, wherein the electronics comprise:

an array of light emitting elements; and control circuitry for controlling illumination of individual light emitting elements of the array of light emitting elements.

10. The apparatus of claim 9, wherein the array of light emitting elements comprises a plurality of light emitting diodes.

11. The apparatus of claim 9, wherein the control circuitry controls selectively pulsing on/off of individual light emitting elements of the array of light emitting elements in accordance with an image to be generated by the array of light emitting elements.

12. The apparatus of claim 11, wherein the control circuitry selectively pulses on/off light emitting elements in the array of light emitting elements by:

receiving an index pulse, from an index pulse generator associated with an actuator providing a force to rotate the portion of the first arm about the first axis, indicative of a position of the electronics along a path of motion of the electronics; and determining a timing for pulsing on/off the light emitting elements based on the index pulse.

13. The apparatus of claim 9, wherein the electronics are moved through a path of motion, the path of motion being defined by the rotation of the portion of the first arm about the first axis and the rotation of the second arm about the second axis, and wherein the array of light emitting elements is controlled to generate a floating image in a space traversed by the path of motion of the electronics.

14. The apparatus of claim 9, wherein the control circuitry comprises a programmable controller, and wherein the programmable controller is programmed with data corresponding to the image to be generated by the array of light emitting elements.

15. The apparatus of claim 14, wherein the programmable controller is programmed via a user interface and one of a wired or wireless communication link between the programmable controller and the user interface.

16. A method of providing an apparatus for moving electronics through a path of motion, comprising:

providing a first arm configured for a portion of the first arm to be rotated about a first axis running along the length of the first arm;

providing electronics coupled to the first arm;

providing a second arm configured to be rotated about a second axis perpendicular to the first axis; and providing an inductive power coupling coil pair coupled to the first arm and the second arm, wherein the inductive power coupling coil comprises:

a first coil coupled to the first arm and a second coil coupled to the second arm such that the first coil and the second coil are substantially perpendicular to one another; and a magnetic core coupled to one of the first arm or the second arm, wherein the magnetic core transfers power, via an induced magnetic flux, from the first coil to the second coil in response to an electrical current being applied to the first coil, and wherein the electronics are moved through a path of motion by virtue of the rotation of the first arm about the first axis and the rotation of the second arm about the second axis, and wherein the electronics are provided with electrical power via the inductive power coupling coil pair.

17. The method of claim 16, wherein the first arm comprises:

an outer shaft configured to be stationary; and an inner shaft configured to be rotated within the outer shaft about the first axis.

18. The method of claim 17, wherein the inner shaft is coupled to an actuator for rotating the inner shaft within the outer shaft, and wherein the inner shaft is coupled to the magnetic core such that the magnetic core is rotated about the first axis in response to the inner shaft being rotated about the first axis.

19. The method of claim 18, wherein the magnetic core is rotated about the first axis within a center of the first coil such that a magnetic flux is created in the magnetic core when the electrical current is applied to the first coil.

20. The method of claim 16, wherein:

the magnetic core is configured to have a first leg and a second leg, the first leg is approximately 90 degrees in orientation to the second leg, the first leg is configured to be within a center of the first coil, and the second leg is configured to be within a center of the second coil such that when the magnetic flux is generated in the first leg of the magnetic core, the magnetic flux is transferred through the first leg to the second leg to generate an electrical current in the second coil.

* * * * *